United States Patent [19]

Morse

[11] Patent Number: 4,823,729

[45] Date of Patent: Apr. 25, 1989

[54] MACHINE FOR APPLYING A FUSED CONFIGURATION OF POWDER ON A SHOE SUBSTRATE

[75] Inventor: Albert I. Morse, Beverly, Mass.

[73] Assignee: DVSG Patentverwaltungs, Frankfurt, Fed. Rep. of Germany

[21] Appl. No.: 4,507

[22] Filed: Jan. 20, 1987

[51] Int. Cl.[4] ..... B05C 1/16

[52] U.S. Cl. ..... 118/213; 12/146 D; 156/230; 425/388

[58] Field of Search ..... 156/230, 283, 578; 445/73; 264/135; 118/213, 380, 301, 406; 425/388, 389; 12/61 A, 61 B, 146 D

[56] References Cited

U.S. PATENT DOCUMENTS

| | | | |
|---|---|---|---|
| 2,522,969 | 9/1950 | Smith | 445/73 |
| 2,707,249 | 4/1955 | Schneider | 445/73 |
| 2,861,861 | 11/1958 | Hoffmann | 445/73 |
| 2,995,482 | 8/1961 | Boyce et al. | 156/283 |
| 4,087,224 | 5/1978 | Moser | 425/388 |
| 4,128,375 | 12/1978 | Schubart | 425/389 |
| 4,353,862 | 10/1982 | Kamau | 264/135 |
| 4,475,477 | 10/1984 | Morse et al. | 118/202 |
| 4,592,798 | 6/1986 | Simmonds, Jr. et al. | 156/230 |
| 4,650,538 | 3/1987 | Simmonds, Jr. et al. | 156/578 |
| 4,661,198 | 4/1987 | Simmonds, Jr. et al. | 156/578 |

*Primary Examiner*—Jay H. Woo
*Assistant Examiner*—C. Scott Bushey
*Attorney, Agent, or Firm*—Owen J. Meegan; Aubrey C. Brine

[57] ABSTRACT

Powder is deposited onto an underlying flat belt through a selectively shaped cut-out in a stencil assembly. The desired volume for the deposited powder is achieved by defining a closed volume beneath the deformable belt with a support pad having a spacer receiving opening. Vacuum is applied to this closed volume drawing the belt downwardly against the spacer thereby defining this volume. The spacer is removable so that this volume can be changed by changing the spacer.

7 Claims, 2 Drawing Sheets

MACHINE FOR APPLYING A FUSED CONFIGURATION OF POWDER ON A SHOE SUBSTRATE

BACKGROUND OF THE INVENTION

The present invention relates to machines which deposit powder on a conveyor belt in a selected configuration, fuse the configured powder into a laminate and adhere the fused laminate to a shoe substrate to reinforce the substrate.

In state of the art machines such as illustrated in U.S. Pat. No. 4,592,798 dated June 3, 1986, a flat support is elevated from a position beneath the receiving belt to push the receiving belt against the screen of a printer assembly. Gaskets secured to the screen around the screen stencil deform the receiving belt to define the desired powder receiving volume. (Gaskets or shims may also be secured to the top surface of the flat support to define precise edges for this volume). In such machines, it is not possible to form a scarf (a taper on the outside edge of the volume) completely around the periphery of the volume of deposited powder.

It is an object of the present invention to provide an improved structure for forming this powder receiving volume.

An advantage of the present invention is that a scarf can be formed by this improved structure completely around the periphery of the deposited powder.

BRIEF DESCRIPTION OF THE DRAWING

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

DESCRIPTION OF THE PREFERRED EMBODIMENT

Figure 1:
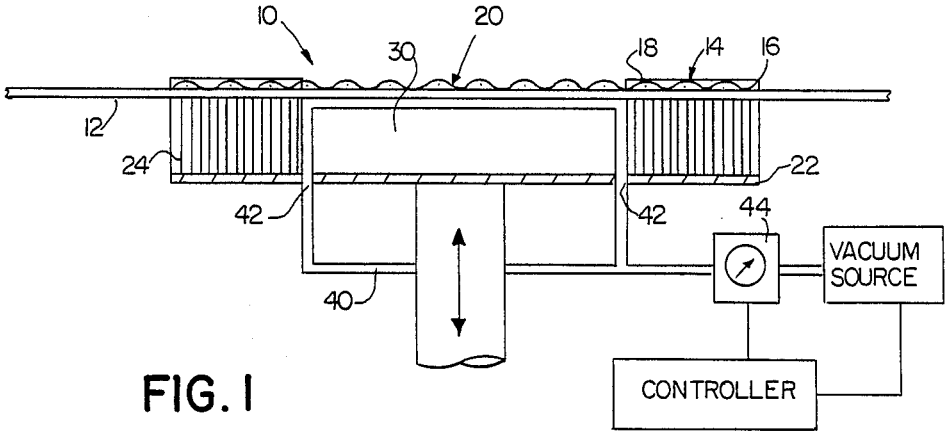
FIG. 1 is a side cross-sectional view of the lower support plate assembly for a machine which deposits powder in a selected configuration, fuses the configured powder into a laminate and adheres the fused laminate to a shoe substrate to reinforce the substrate which has been elevated into engagement with the portion of the conveyor belt of the machine which underlies the screen assembly which deposits powder on the conveyor belt.

In a machine 10 which deposits powder in a selected configuration, fuses the configured powder into a laminate and adheres the fused laminate to a shoe substrate to reinforce the substrate, a powder receiving surface, here an annular belt 12, is displaced from a powder deposition station, through a fusing station to a joining station. The deposition station, which is illustrated in FIG. 1, includes a powder deposition assembly 14 having a screen 16 which is selectively covered or sealed with a laminate 18 to define a cut-out or stencil 20 having the configuration of the desired laminate. Powder will be deposited on the screen and wiped into the cut-out and onto the receiving belt below by conventional structure not shown.

Figure 2:
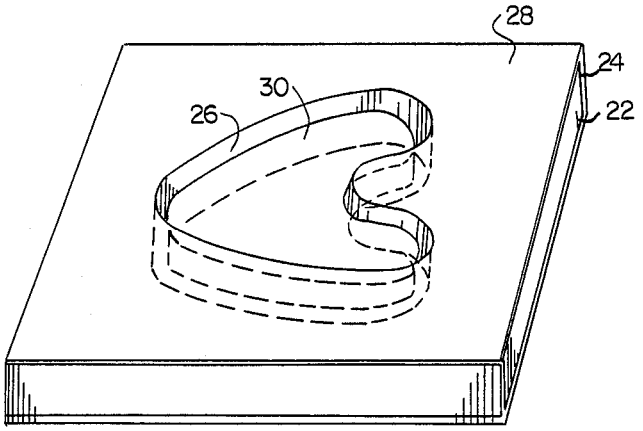
FIG. 2 is a top oblique view of a portion of the lower support plate assembly.

The lower support assembly which is to form the desired powder receiving volume includes a mounting plate 22 to which is secured a soft rubber pad 24. The plate 22 is raised from a lowered position (not shown) remote from the belt to the illustrated upper position where the soft rubber pad 24 forcefully locates the belt against the screen. Cut into the soft rubber pad 24 is an arcuate opening 26 (see FIG. 2) which extends vertically from the top surface 28 of the pad 24 downwardly to the mounting plate 22. This arcuate opening 26 conforms to the screen opening or stencil 20. Placed within the pad opening 26 is a spacer 30 which has a selected thickness which can be changed by replacing the spacer with another spacer having a different thickness.

Figure 4:
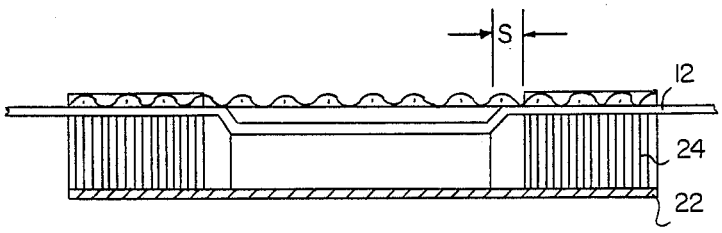
FIG. 4 is a view similar to FIG. 3 with a full vacuum being applied to the support plate.
Figure 3:
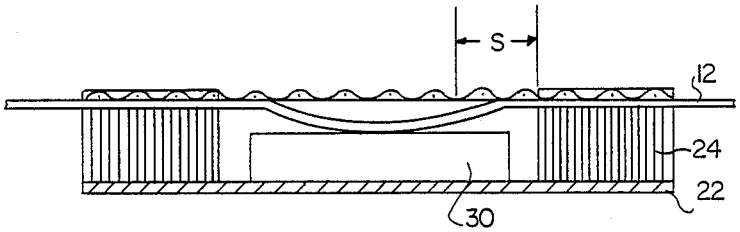
FIG. 3 is a cross-sectional view of the support plate and supported conveyor belt with partial vacuum being applied to the support plate.

A vacuum 40 which communicates with the arcuate opening 26 via suitable apertures 42 in the support plate 22 is controlled by a Vacuum Source which is timed to the print cycle by a suitable Controller. A settable needle valve 44 controls the amount of vacuum applied, and hence, the degree of deformation of the belt. With the lower support assembly in the upper position, an effective seal will be defined between the screen and the belt around the opening and operation of the Vacuum Source will accordingly pull the belt 12 downwardly against the spacer 30. With a partial vacuum, the belt 12 will partially deform, as shown in FIG. 3, thereby defining long scarfs and with full vacuum (FIG. 4), the belt will be pulled down into full engagement with the top surface of the spacer thereby defining short scarfs. By varying the vacuum, the peripheral taper or scarf length can accordingly be varied. The scarf accordingly can be formed completely around the part and this will make shoe forming easier.

Figure 5:
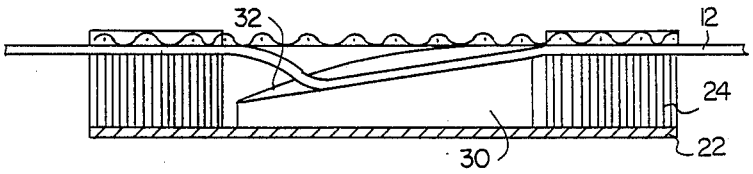
FIG. 5 is a view similar to FIG. 4 illustrating an alternate embodiment.

The definition of the volume can be thereby controlled by the design of the spacer 30 which can have a horizontal, or inclined and/or contoured upper surface 32 (FIG. 5) and by varying the extent of the vacuum. The vacuum will be gently released as the screen lifts so that the deposited volume of powder will not be disturbed.

I claim:

1. A machine for applying a fused configuration of powder on a shoe substrate comprising:

a non-rigid deformable flat belt for receiving a deposit of powder on an upper surface thereof;

a stencil disposed above said belt and having a selectively configured cut-out;

means communicating with said stencil for depositing powder onto said stencil;

means for deforming from said flat condition a portion of said belt beneath said cut-out to define with said stencil a selectively configured powder receiving volume, said means including:

a lower support assembly disposed beneath said belt comprising:

a support pad adapted to be elevated to forcefully engage said belt against said stencil;

an arcuate opening extending vertically downwardly into said support pad:

a selectively configured removable spacer element located within said opening having a top surface spaced from said belt with the lower support assembly in the elevated position wherein said belt is forcefully engaged against said stencil: and vacuum means communicating with said arcuate opening to pull said belt downwardly against the top surface of said spacer element thereby defining a selectively configured volume to receive powder deposited on said stencil.

2. A machine according to claim 1 further comprising means for varying a negative pressure produced by said vacuum means.

3. A machine according to claim 1 further comprising controller means for controlling application of said vacuum means.

4. A machine according to claim 1 wherein said top surface of said removable spacer element is disposed substantially parallel with said flat belt in an undeformed state with said removable spacer element located in said arcuate opening.

5. A machine according to claim 1 wherein said top surface of said removable spacer element is disposed substantially inclined with said flat belt in an undeformed state with said removable spacer element located in said arcuate opening.

6. A machine according to claim 4 further comprising means for varying a negative pressure produced by said vacuum means.

7. A machine according to claim 5 further comprising means for varying a negative pressure produced by said vacuum means.

* * * * *